US009946211B2

(12) United States Patent
Oyama

(10) Patent No.: US 9,946,211 B2
(45) Date of Patent: Apr. 17, 2018

(54) IMAGE FORMING APPARATUS

(71) Applicant: BROTHER KOGYO KABUSHIKI KAISHA, Nagoya-shi, Aichi-ken (JP)

(72) Inventor: Yoshihiro Oyama, Tokai (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 15/370,407

(22) Filed: Dec. 6, 2016

(65) Prior Publication Data

US 2017/0168445 A1 Jun. 15, 2017

(30) Foreign Application Priority Data

Dec. 10, 2015 (JP) ..... 2015-241417

(51) Int. Cl.
*G03G 15/00* (2006.01)
*G03G 15/23* (2006.01)

(52) U.S. Cl.
CPC ..... *G03G 15/6579* (2013.01); *G03G 15/234* (2013.01); *G03G 15/6529* (2013.01); *G03G 2215/00586* (2013.01)

(58) Field of Classification Search
CPC ..... G03G 15/6579
USPC ..... 399/401
See application file for complete search history.

(56) References Cited

U.S. PATENT DOCUMENTS 8,746,685 B1 * 6/2014 Fukuzawa ..... B65H 29/58 271/184
8,989,651 B2 * 3/2015 Mori ..... G03G 15/6573 399/401
9,828,200 B2 * 11/2017 Kuwata ..... B65H 7/20
2006/0093419 A1 * 5/2006 Kitamura ..... G03G 15/234 399/401
2012/0119436 A1 * 5/2012 Morita ..... B65H 7/14 271/259

FOREIGN PATENT DOCUMENTS

JP 2005-138964 A 6/2005
JP 2009-105603 A 5/2009

* cited by examiner

*Primary Examiner* — Anthony Nguyen
(74) *Attorney, Agent, or Firm* — Scully, Scott, Murphy & Presser, P.C.

(57) ABSTRACT

An image forming apparatus includes a process unit to form an image onto a sheet. A fixer fixes the image to the sheet. A reverse roller makes a positive rotation to convey the sheet in a forward direction from the fixer, and makes an opposite rotation to convey the sheet in an opposite direction. A returner returns the sheet to the process unit. A branching member guides the sheet from the reverse roller to the returner. A first sensor detects the sheet. The controller controls the reverse roller to make the positive rotation at a circumferential speed higher than a speed of the sheet conveyed by the fixer, controls the reverse roller to wait for predetermined waiting time after the first sensor has detected a rear end of the sheet, and makes the waiting time shorter as a length of the sheet is greater.

14 Claims, 8 Drawing Sheets

IMAGE FORMING APPARATUS

CROSS-REFERENCE TO RELATED APPLICATIONS

The present application claims priority under 35 U.S.C. § 119 to Japanese Patent Application No. 2015-241417, filed Dec. 10, 2015. The contents of this application are incorporated herein by reference in their entirety.

TECHNICAL FIELD

The present disclosure relates to an image forming apparatus.

BACKGROUND

JP 2005-138964A discloses an image forming apparatus capable of printing on the front surface and the opposite surface of a sheet. The image forming apparatus includes a process unit, a fixer, reverse rollers, and a sensor. The process unit forms a developing agent image onto the sheet. The fixer includes a heating section and pressure rollers to, while transferring the sheet, fix the developing agent image, formed at the process unit, to the sheet. The reverse rollers convey the sheet transferred from the fixer. The sensor is disposed between the fixer and the reverse rollers to detect the sheet. When the image forming apparatus performs duplex printing, the reverse rollers first rotate positively to convey the sheet transferred from the fixer. The reverse rollers then rotate oppositely after elapsing a predetermined period of time since the sensor detects the trailing end of the sheet. This causes the sheet to be conveyed in a direction opposite to the direction in which the sheet is to be discharged, and causes the sheet to return to the process unit.

In the image forming apparatus, a branching member is disposed between the fixer and the reverse rollers. The branching member guides the sheet to a passage toward the process unit when the sheet is conveyed by the reverse rollers rotating oppositely. The sensor is disposed between the branching member and the reverse rollers.

SUMMARY

According to one aspect of the present disclosure, an image forming apparatus includes a process unit, a fixer, a reverse roller, a returner, a branching member, a first sensor, and a controller. The process unit is configured to form a developing agent image onto a sheet. The fixer is configured to convey the sheet in a forward direction to fix the developing agent image to the sheet using a heater and a pressurizer of the fixer. The reverse roller is configured to make a positive rotation to convey the sheet in the forward direction from the fixer, and is configured to make an opposite rotation to convey the sheet in an opposite direction opposite to the forward direction. The returner is configured to return the sheet, conveyed in the opposite direction, to the process unit. The branching member is configured to guide the sheet from the reverse roller to the returner past a branching point of the branching member. The branching point is located at an end portion of the branching member that is closer to the reverse roller than a remaining portion of the branching member is to the reverse roller. The first sensor is disposed at a position upstream of the branching point in the positive direction to detect the sheet. The controller is configured to control the reverse roller to make the positive rotation at a circumferential speed higher than a first conveyance speed of the sheet conveyed by the fixer, configured to control the reverse roller to wait for a predetermined period of waiting time after the first sensor has detected a rear end of the sheet, and configured to make the waiting time shorter as a length of the sheet is greater.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DESCRIPTION OF THE EMBODIMENTS

Figure 1:
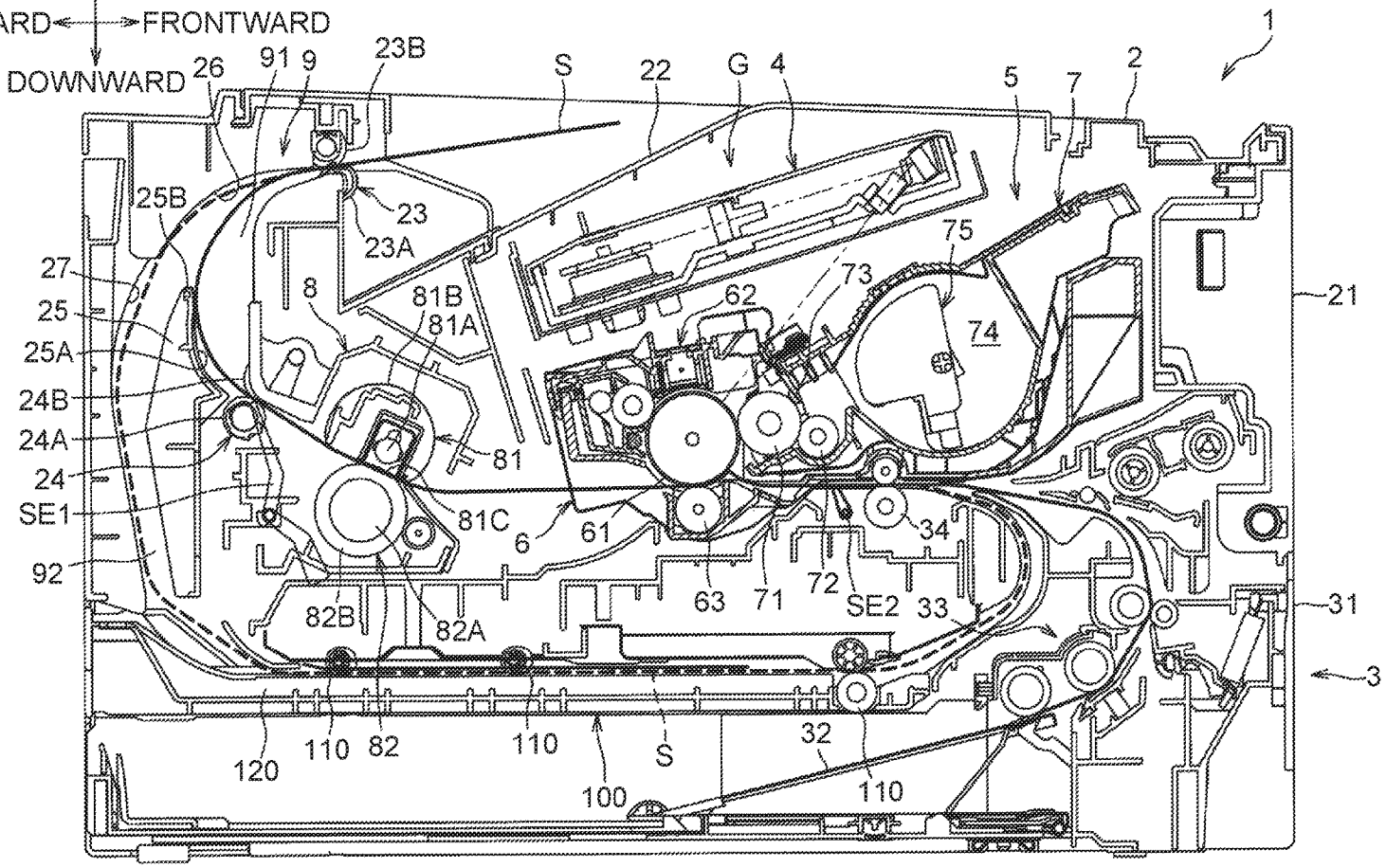
FIG. 1 illustrates a schematic configuration of a laser printer.

The embodiments will now be described with reference to the accompanying drawings, wherein like reference numerals designate corresponding or identical elements throughout the various drawings.

In the following description, a schematic configuration of the image forming apparatus according to this embodiment will be first described, and then features of the embodiment will be detailed. FIG. 1 illustrates a schematic configuration of a laser printer according to an embodiment. The directions referred to in the following description are identical to the directions illustrated in FIG. 1. Specifically, the rightward direction in FIG. 1, which is in landscape orientation, will be denoted "frontward direction", "frontward", or "front"; the leftward direction in FIG. 1 will be denoted "rearward direction", "rearward", "rear", or "behind". The terms "upward", "upper", and "above" may occasionally be used to refer to the upward direction in FIG. 1. The terms "downward", "lower", "under", and "below" may occasionally be used to refer to the downward direction in FIG. 1 will be denoted direction.

A laser printer 1 illustrated in FIG. 1 is a non-limiting example of the image forming apparatus recited in the appended claims. The laser printer 1 includes a body housing 2, a sheet feeder 3, an image forming unit G, and a conveyor 9. The sheet feeder 3 supplies a sheet S, which is a non-limiting example of the sheet recited in the appended claims. The image forming unit G forms an image onto the sheet S that has been fed. The conveyor 9 conveys the sheet S transferred from the image forming unit G As used herein, the term "forward direction" refers to the direction in which the sheet S is conveyed along the conveyance passage through the image forming unit G and the conveyor 9 toward the outside of the body housing 2. The term "opposite direction" refers to the direction opposite to the "positive direction".

The sheet feeder 3 is disposed at a lower portion in the body housing 2, and includes a feeding tray 31, a pressure plate 32, a paper feeding mechanism 33, and a registration roller 34. The feeding tray 31 accommodates sheets S. The registration roller 34 is a non-limiting example of the first conveyance roller recited in the appended claims.

The registration roller 34 is disposed at a position that is downstream of the paper feeding mechanism 33 in the forward direction and that is upstream of a photosensitive drum 61 of the image forming unit G in the forward direction. The registration roller 34, while temporarily not rotating, receives the leading end of the sheet S fed from the paper feeding mechanism 33 to correct skew, if any, of the sheet S and to adjust timings or other parameters related to the image formation on the sheet S. The circumferential speed of the registration roller 34 is approximately identical to the circumferential speed of the photosensitive drum 61. This configuration eliminates or minimizes bending or pulling of the sheet S between the registration roller 34 and the photosensitive drum 61, and ensures stable conveyance of the sheet S between the registration roller 34 and the photosensitive drum 61.

The sheet feeder 3 uses the pressure plate 32 to urge the sheets S in the feeding tray 31 in the upward direction, and uses the paper feeding mechanism 33 and the registration roller 34 to forward one sheet 51 at a time to the image forming unit G.

The image forming unit G includes an exposure device 4, a process cartridge 5, and a fixer 8. The process cartridge 5 is a non-limiting example of the process unit recited in the appended claims.

The exposure device 4 is disposed at an upper portion in the body housing 2, and includes a laser emitter (not illustrated), a polygon mirror, at least one lens, and at least one reflecting mirror. The polygon mirror, the lens, and the reflecting mirror are illustrated without legends. The laser emitter emits laser light (see the dashed double-dotted lines) based on image data. The exposure device 4 scans the laser light at high speed on the surface of the photosensitive drum 61 to expose the surface of the photosensitive drum 61.

The process cartridge 5 is configured to form a toner image onto the paper sheet S. The toner image is a non-limiting example of the developing agent image recited in the appended claims. The process cartridge 5 is disposed below the exposure device 4, and is attachable to and detachable from the body housing 2 through an opening defined when a front cover 21 of the body housing 2 is open. The process cartridge 5 includes a drum unit 6 and a developing unit 7. The drum unit 6 includes the photosensitive drum 61, a scorotron charger 62, and a transfer roller 63. The photosensitive drum 61 is a non-limiting example of the photoreceptor recited in the appended claims. The developing unit 7 includes a developing roller 71, a supply roller 72, a layer-thickness regulating blade 73, a container 74, and an agitator 75. The container 74 accommodates positively-charged toner, which is a non-limiting example of the developing agent. The agitator 75 rotates in the container 74.

The charger 62 uniformly charges the surface of the photosensitive drum 61 while the photosensitive drum 61 is rotating about the axis of the photosensitive drum 61. Then, the laser light emitted, based on image data, from the exposure device 4 exposes the surface of the photosensitive drum 61 to form an electrostatic latent image on the photosensitive drum 61. The agitator 75 rotates in the container 74 to agitate the toner in the container 74 and transfer the toner toward the developing roller 71. The supply roller 72 rotates while contacting with the developing roller 71 to supply the toner transferred from the container 74 to the developing roller 71. The developing roller 71 rotates while contacting with the layer-thickness regulating blade 73 to receive the toner regulated to a uniform thickness.

Then, the toner carried on the developing roller 71 is supplied to the photosensitive drum 61 so as to turn the electrostatic latent image into a visible image, thus forming a toner image onto the photosensitive drum 61. Then, while the sheet S supplied from the sheet feeder 3 passes between the photosensitive drum 61 and the transfer roller 63, the toner image on the photosensitive drum 61 is transferred to the sheet S.

The fixer 8 is disposed behind the process cartridge 5. The fixer 8 includes a heater 81 and a pressure roller 82. The heater 81 includes a halogen heater 81A, a fixing belt 81B, and a nip plate 81C. The pressure roller 82 is a non-limiting example of the pressurizer recited in the appended claims.

The pressure roller 82 includes a shaft 82A and a roller body 82B. The shaft 82A extends in a direction parallel to the rotation axis of the photosensitive drum 61. The roller body 82B and the shaft 82A are integrally rotatable about the shaft 82A. The roller body 82B is made of rubber or another elastically deformable material that makes the roller body 82B deformed with the fixing belt 81B held between the roller body 82B and the nip plate 81C. The pressure roller 82 receives rotational driving force.

The fixer 8 conveys the sheet S loaded with the toner image in the forward direction between the heater 81 and the pressure roller 82 so as to fix, using heat, the toner image to the sheet S.

The conveyor 9 functions as a discharge mechanism to discharge the sheet S transferred from the fixer 8 to a discharge tray 22, which is disposed at an upper portion of the body housing 2. The conveyor 9 also functions as a returning mechanism to forward the sheet S transferred from the fixer 8 to the process cartridge 5 such that the sheet S is turned over when the sheet S arrives at the process cartridge 5. The conveyor 9 includes a conveyance passage 91, a return passage 92, discharge rollers 23, a guide member 25, a first guide 26, a second guide 27, and a returning unit 100. The discharge rollers 23 are non-limiting examples of the reverse roller recited in the appended claims. The guide member 25 is a non-limiting example of the branching member recited in the appended claims. The second guide 27 is a non-limiting example of the guide recited in the appended claims. The returning unit 100 is a non-limiting example of the returner recited in the appended claims. The conveyor 9 also includes conveyance rollers 24.

The conveyance passage 91 is disposed at a rear portion in the body housing 2 and is a passage through which the paper sheet S transferred from the fixer 8 passes. The conveyance passage 91 has a curved shape extending approximately in the upward direction from a position behind the fixer 8, and then extends approximately in the frontward direction.

The return passage 92 is a passage through which the paper sheet S transferred from the fixer 8 is forwarded to the process cartridge 5. The return passage 92 branches off in the rearward direction from the conveyance passage 91 and extends approximately in the downward direction. Then, the return passage 92 curves approximately in the frontward direction passing over the feeding tray 31, and then extends approximately in the upward direction to a position upstream of the registration roller 34 in the forward direction.

The conveyance rollers 24 are non-limiting examples of the second conveyance roller recited in the appended claims. The conveyance rollers 24 are disposed on the conveyor 9 between a branching point 25B of the guide member 25 and the fixer 8 to convey the sheet S transferred from the fixer 8. Providing the conveyance rollers 24 in this manner may stabilize the conveyance of the sheet S from the heater 81 and the pressure roller 82. The conveyance rollers 24 include a first roller 24A and a second roller 24B. The first roller 24A receives driving force from the driving source disposed in the body housing 2. The second roller 24B cooperates with the first roller 24A to hold the sheet S between the first roller 24A and the second roller 24B.

The discharge rollers 23 are disposed above the fixer 8 and at the outlet of the conveyance passage 91. The discharge rollers 23 positively rotate to convey the sheet S transferred from the conveyance roller 24 in the forward direction, and oppositely rotate to convey the sheet S in the opposite direction. The discharge rollers 23 include a first discharge roller 23A and a second discharge roller 23B. The first discharge roller 23A is rotatable by the driving force transmitted from the driving source disposed in the body housing 2. The second discharge roller 23B cooperates with the first discharge roller 23A to hold the sheet S between the first discharge roller 23A and the second discharge roller 23B.

The guide member 25 is disposed behind the fixer 8 and between the conveyance passage 91 and the return passage 92. While the sheet S is passing through the conveyance passage 91, the guide member 25 guides the sheet S toward the discharge rollers 23. When the paper sheet S is conveyed in the opposite direction through the discharge rollers 23, the guide member 25 guides the sheet S to the returning unit 100.

Specifically, the guide member 25 includes a guide surface 25A. The guide surface 25A faces the fixer 8 and extends upward and rearward away from the fixer 8. As viewed in the axial direction of the pressure roller 82, the guide surface 25A has an arc shape curved toward the heater 81. The guide surface 25A contacts the pressure roller 82-side surface of the sheet S transferred from the fixer 8 to make the sheet S curved toward the heater 81. At the branching point 25B of the guide member 25, the conveyance passage 91 and the return passage 92 furcate. The branching point 25B is located at an upper end portion of the guide member 25 that is closer to the discharge rollers 23 than the remaining portion of the guide member 25 is to the discharge rollers 23.

The first guide 26 is disposed over and spaced apart from the guide member 25 to guide the sheet S through the conveyance passage 91. Specifically, the first guide 26 extends approximately in the frontward direction over the guide member 25 to guide the sheet S, which is now curved along the guide surface 25A, while keeping contact with the sheet S from above the paper sheet S.

The second guide 27 guides the sheet S through the return passage 92. The second guide 27 is disposed opposite to the fixer 8 across the guide member 25 such that the second guide 27 is spaced apart from the guide member 25, and extends approximately in the upward direction and the downward direction. The second guide 27 contacts the paper sheet S conveyed in the opposite direction by the discharge rollers 23 to guide the sheet S approximately in the downward direction.

The returning unit 100 is disposed between the feeding tray 31 and the image forming unit G The returning unit 100 includes a lower portion of the return passage 92 to forward the sheet S guided in the opposite direction by the second guide 27 to the process cartridge 5. The returning unit 100 further includes a plurality of returning rollers 110 and a guide plate 120. The plurality of returning rollers 110 are aligned in the frontward direction and the rearward direction. The guide plate 120 extends between a position approximately under the second guide 27 and a position approximately under the registration roller 34 and guides the sheet S.

An image may be formed on only one surface of the sheet S. In this case, after the image has been formed on the one surface of the sheet S, the fixer 8 conveys the sheet S out of the fixer 8 and through the conveyance passage 91. Then, the discharge rollers 23 positively rotate to discharge the paper sheet S onto the discharge tray 22. An image may also be formed on both surface of the sheet S. In this case, after the image has been formed on one surface of the sheet S, the discharge rollers 23 oppositely rotate before the sheet S is completely discharged by the positive rotation of the discharge rollers 23. The opposite rotation of the discharge rollers 23 causes the sheet S to return to the inside of the body housing 2 and be conveyed to the return passage 92 through the conveyance passage 91. Then, the sheet S is conveyed through the return passage 92 to forward to the process cartridge 5, as indicated by the broken lines.

Then, the image is formed on the other surface of the sheet S conveyed through the return passage 92. Thereafter, the fixer 8 conveys the sheet S to the discharge rollers 23 through the conveyance passage 91. The discharge rollers 23 positively rotate to discharge the sheet S holding images on both surface onto the discharge tray 22.

In this embodiment, the circumferential speed of the conveyance rollers 24 is greater than the conveyance speed of the sheet conveyed by the heater 81 and the pressure roller 82 (this conveyance speed is a non-limiting example of the second conveyance speed recited in the appended claims), and is not greater than the circumferential speed of the discharge rollers 23.

A frictional force may be generated between the conveyance rollers 24 and the sheet S. The frictional force is smaller than a frictional force between the sheet S and the heater 81 and the pressure roller 82. For this purpose, the second roller 24B of the conveyance rollers 24 is made of polyacetal (Polyoxymethylene: POM) or a similar kind of resin that makes the frictional force between the sheet S and the second roller 24B smaller. Setting the frictional force between the sheet S and the second roller 24B in this manner eliminates or minimizes slippage of the sheet S between the heater 81 and the pressure roller 82 even if a difference could occur between the circumferential speed of the conveyance rollers 24 and the conveyance speed of the sheet S conveyed by the heater 81 and the pressure roller 82. Eliminating or minimizing slippage of the sheet S in turn eliminates or minimizes variation of the conveyance speed of the sheet S conveyed by the fixer 8. Additionally, tension occurs on the sheet S between the fixer 8 and the conveyance rollers 24, and the tension stabilizes the conveyance of the sheet S between the fixer 8 and the conveyance rollers 24.

Figure 2:
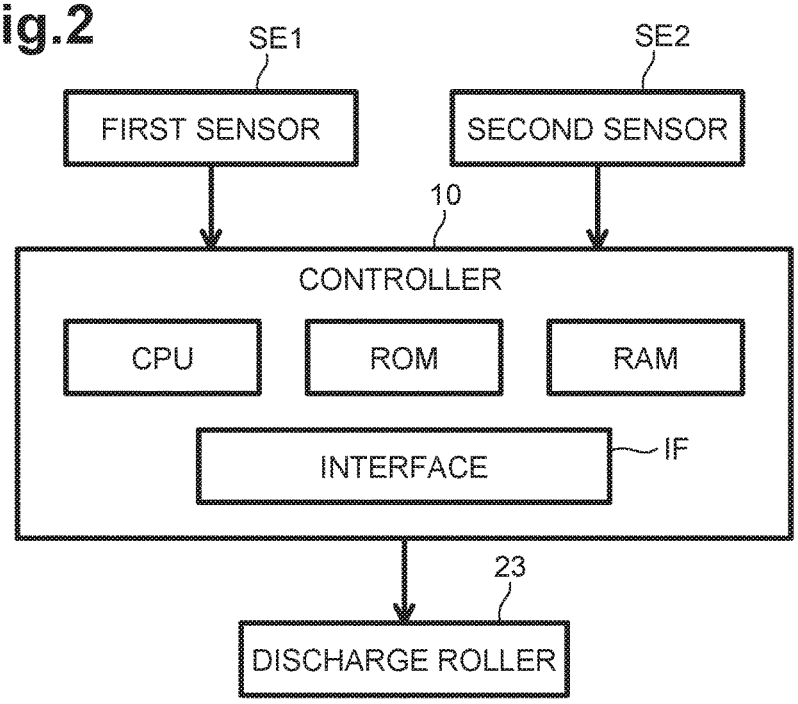
FIG. 2 is a diagram illustrating a first sensor, a second sensor, a controller, and a discharge roller in relation to each other.

As illustrated in FIG. 2, the laser printer 1 includes a first sensor SE1, a second sensor SE2, and a controller 10.

As illustrated in FIG. 1, the first sensor SE1 is disposed at a position that is upstream of the branching point 25B in the forward direction and that is downstream of the heater 81 and the pressure roller 82 in the forward direction. In this embodiment, the first sensor SE1 is disposed between the conveyance rollers 24 and the heater 81 and the pressure roller 82.

The second sensor SE2 is disposed at a position upstream of the fixer 8 in the forward direction. Specifically, the second sensor SE2 is disposed between the registration roller 34 and the photosensitive drum 61.

The first sensor SE1 and the second sensor SE2 each have a known configuration to detect the sheet S. For example, while the first sensor SE1 and the second sensor SE2 are detecting the sheet S, the first sensor SE1 and the second sensor SE2 each output an ON signal to the controller 10.

As illustrated in FIG. 2, the controller 10 includes elements such as CPU, ROM, and RAM to control the discharge rollers 23 based on a program prepared in advance and based on whether the first sensor SE1 and/or the second sensor SE2 has output an ON signal. The controller 10 also includes an interface IF electrically connected to a device, such as a personal computer. The controller 10 is capable of, through the interface IF, receiving a print job from the device.

For conveying the sheet S to the returning unit 100, that is, when the controller 10 receives through the interface IF a print job for duplex printing, the controller 10 performs opposite-rotation control including: controlling the discharge rollers 23 to positively rotate at a circumferential speed higher than the conveyance speed of the sheet S conveyed by the heater 81 and the pressure roller 82 of the fixer 8; controlling the discharge rollers 23 to wait for a predetermined waiting time T after the first sensor SE1 has detected the trailing end of the sheet S; and controlling the discharge rollers 23 to oppositely rotate. When a predetermined period of time elapses since the discharge rollers 23 started oppositely rotating, the controller 10 controls the discharge rollers 23 to positively rotate. In a non-limiting embodiment, the controller 10 may control the discharge rollers 23 to rotate by controlling a driving source, such as a motor, of the discharge rollers 23 to transfer driving force from the driving source to the discharge rollers 23.

Then the controller 10 performs waiting time setting control including: setting the waiting time T shorter as the sheet S has a longer length; and setting the waiting time T longer as the conveyance speed of the sheet S conveyed by the fixer 8 is higher.

The controller 10 determines the length of the sheet S based on the detection result of the second sensor SE2. Specifically, the controller 10 determines the length of the sheet S based on the period of time for which the second sensor SE2 outputs the ON signal. More specifically, the second sensor SE2 outputs the ON signal when the leading end of the sheet S that is being conveyed passes the second sensor SE2, and stops outputting the ON signal when the trailing end of the sheet S passes the second sensor SE2. Thus, the controller 10 determines the length of the sheet S based on the conveyance speed of the sheet S and based on the period of time for which the second sensor SE2 outputs the ON signal. When the controller 10 determines that the length of the sheet S is not less than a predetermined length, the controller 10 sets length flag L1. When the controller 10 determines that the length of the sheet S is less than the predetermined length, the controller 10 sets the length flag L2. A non-limiting example of the predetermined length may be the longitudinal length of an A4 sheet, i.e., 297 mm.

Otherwise, the length of the sheet S may be determined based on sheet-size information of the sheet S contained in the feeding tray 31. If the sheet-size information indicates that the sheet S is A4, A3, B4, or Legal, the controller 10 may determine that the length of the sheet S is not less than the predetermined length and may set the length flag L1. If the sheet-size information indicates that the sheet S is Letter, B5, B6, or greeting card, the controller may determine that the length of the sheet S is less than the predetermined length and may set the length flag L2.

When the controller 10 receives a print job, the controller 10 starts counting the number of sheets printed from a cold start (this number will be hereinafter denoted N). As used herein, the term cold start refers to a state in which the temperature of the fixer 8 is approximately identical to room temperature after, for example, a long period of OFF state of the power source of the laser printer 1. In this embodiment, it may be determined whether the current state is a cold start, comparing an output of a temperature detector with an output of a thermometer. The temperature detector is disposed in the laser printer 1 to detect the temperature of the fixer 8. The thermometer is disposed in the laser printer 1 to detect environment temperature. If the difference between the output of the temperature detector and the output of the thermometer is within a predetermined range, the controller may determine that the current state of the laser printer 1 is the cold start. As the number N increases, heat accumulates in the pressure roller 82 of the fixer 8. As heat accumulates in the pressure roller 82, the roller body 82B of the pressure roller 82 dilates, and thus the diameter of the roller body 82B may be increased. If the roller body 82B dilates while the pressure roller 82 is rotating at uniform rotational speed, the conveyance speed of the sheet S conveyed by the fixer 8 increases. This leads to the assumption that as the number N increases, the conveyance speed of the sheet S conveyed by the fixer 8 increases.

Figure 3:
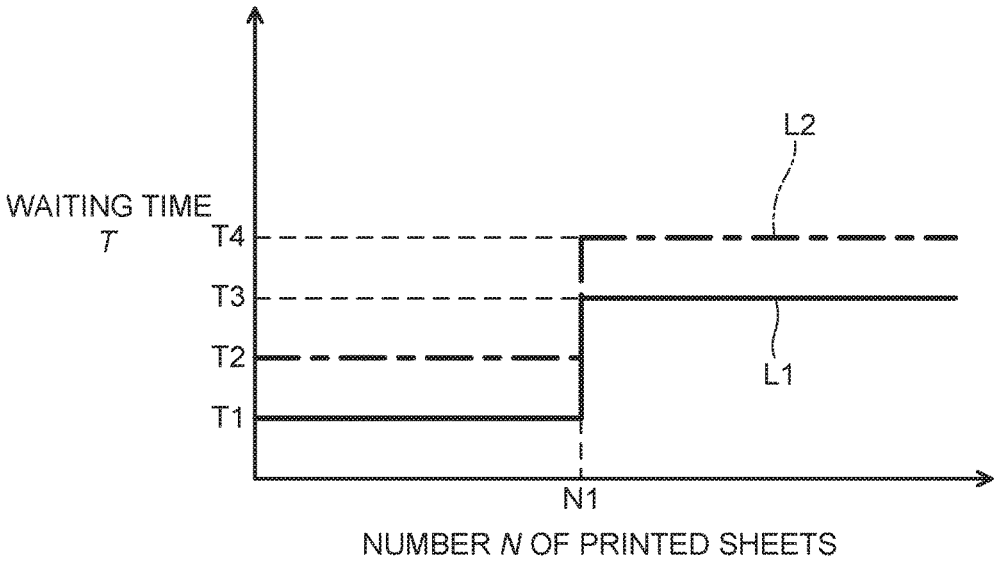
FIG. 3 is a map illustrating the number of sheets printed from a cold start relative to waiting time, for different sheet lengths.

In this embodiment, the controller 10 stores a map as illustrated in FIG. 3. By referring to the map, the controller 10 sets the waiting time T based on the length of the sheet S and based on the number N. When the number N is less than predetermined number N1, e.g., 20, the map dictates that the waiting time T be set at first time T1 when the length flag L1 is set, and that the waiting time T be set at second time T2, which is longer than the first time T1, when the length flag L2 is set. When the number N is equal to or greater than the predetermined number N1, the map dictates that the waiting time T be set at third time T3, which is longer than the first time T1, when the length flag L1 is set, and that the waiting time T be set at fourth time T4, which is longer than the third time T3, when the length flag L2 is set.

Figure 4:
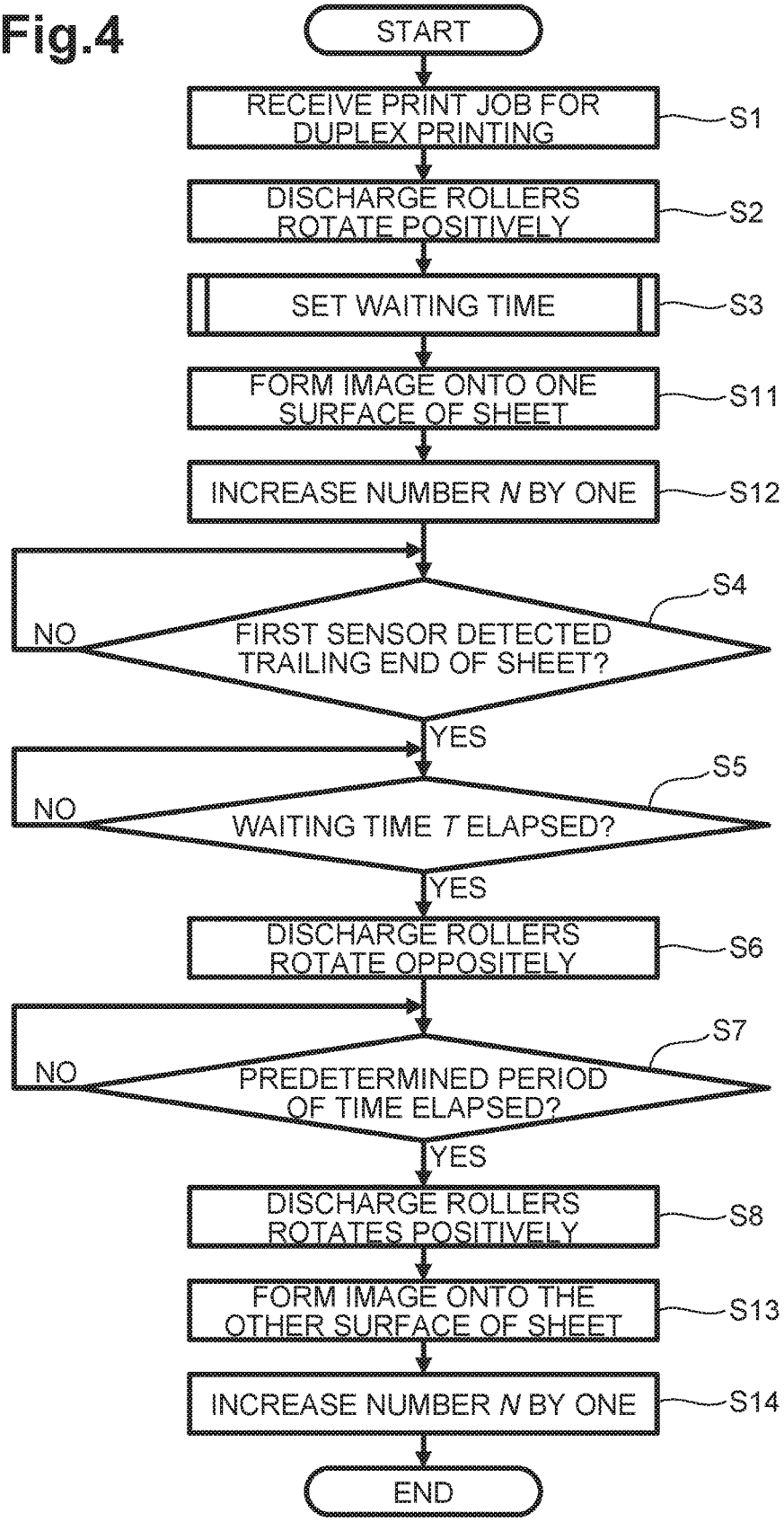
FIG. 4 is a flowchart of a control operation performed by the controller.

Next, a control operation performed by the controller 10 will be described. As illustrated in FIG. 4, upon receipt of a print job for duplex printing (S1), the controller 10 controls the discharge rollers 23 to positively rotate (S2).

Figure 5:
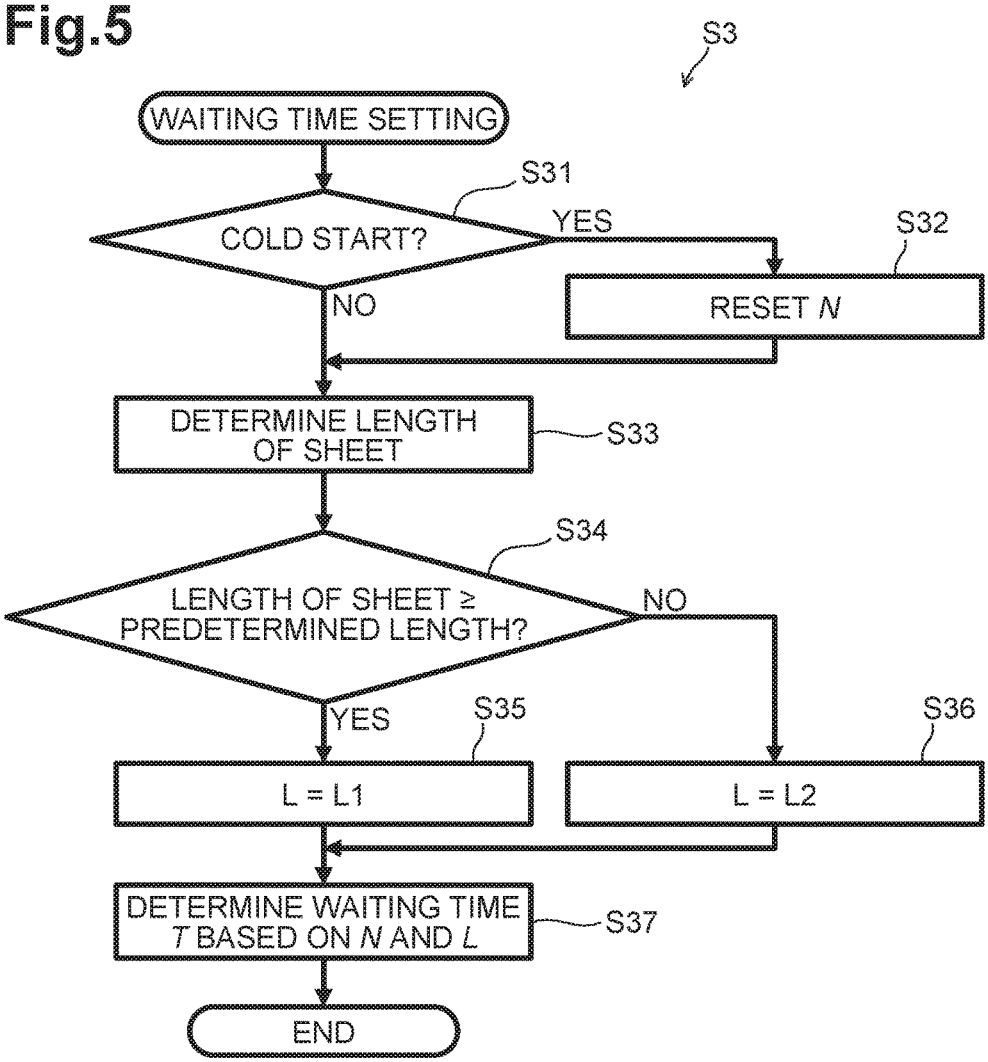
FIG. 5 is a flowchart of waiting time setting performed by the controller.

Next, the controller 10 performs waiting time setting (S3). As illustrated in FIG. 5, in the waiting time setting, the controller 10 determines whether the current state is a cold start (S31).

When at step S31 the controller 10 determines that the current state is the cold start (S31, Yes), the controller 10 resets the number N, that is, sets the number N at zero (S32). Next, the controller 10 determines the length of the sheet S (S33).

When at step S31 the controller 10 determines that the current state is not a cold start (S31, No), the controller 10 keeps the number N unchanged, and at step S33 determines the length of the sheet S.

After the controller 10 has determined the length of the sheet S at step S33, the controller 10 determines whether the length of the sheet S is not less than a predetermined length (S34).

When at step S34 the controller 10 has determined that the length of the sheet S is not less than the predetermined length (S34, Yes), the controller 10 sets the length flag L1 (S35). When at step S34 the controller 10 has determined that the length of the paper sheet S is less than the predetermined length (S34, No), the controller 10 sets the length flag L2 (S36).

After the controller 10 has set the length flag L1 or L2 at step S35 or step S36, the controller 10 refers to the map to determine the waiting time T based on the number N and the length flag (S37), and ends the waiting time setting.

Referring again to FIG. 4, after the waiting time setting, the controller 10 starts forming an image onto one surface of the sheet S (S11), and increases the number N by one (1) (S12).

Next, the controller 10 determines whether the first sensor SE1 has detected the trailing end of the sheet S (S4). When at step S4 the controller 10 has determined that the first sensor SE1 has not detected the trailing end of the sheet S (S4, No), the controller 10 waits until the first sensor SE1 detects the trailing end of the sheet S.

When at step S4 the controller 10 has determined that the first sensor SE1 has detected the trailing end of the sheet S (S4, Yes), the controller 10 determines whether the waiting time T has elapsed since the first sensor SE1 detected the trailing end of the sheet S (S5). When at step S5 the controller 10 has determined that the waiting time T has not elapsed (S5, No), the controller 10 waits until the waiting time T elapses while controlling the discharge rollers 23 to rotate positively.

When at step S5 the controller 10 has determined that the waiting time T has elapsed (S5, Yes), the controller 10 controls the discharge rollers 23 to oppositely rotate (S6).

Next, the controller 10 determines whether a predetermined period of time has elapsed since the controller 10 started controlling the discharge rollers 23 to oppositely rotate (S7). When at step S7 the controller 10 has determined that the predetermined period of time has not elapsed (S7, No), the controller 10 waits until the predetermined period of time elapses after controlling the discharge rollers 23 to oppositely rotate.

When at step S7 the controller 10 has determined that the predetermined period of time has elapsed (S7, Yes), the controller 10 controls the discharge rollers 23 to positively rotate (S8).

After step S8, the controller 10 starts forming an image onto the other surface of the sheet S (S13), and increases the number N by one (1) (S14). Then, the controller 10 controls the discharge rollers 23 to further positively rotate to discharge the sheet S, and ends the control operation.

Description will be made with regard to operations performed by the laser printer 1 and resulting advantageous effects. In response to an input of a print job into the laser printer 1 for duplex printing, the fixer 8 and the discharge rollers 23 are driven into operation. Specifically, the discharge rollers 23 are driven to positively rotate. Then, the discharge rollers 23 rotate at a circumferential speed higher than the conveyance speed of the sheet S conveyed by the heater 81 and the pressure roller 82 and higher than the circumferential speed of the conveyance rollers 24.

The sheet S transferred from the fixer 8 comes into contact with the guide surface 25A of the guide member 25 to make the leading end of the sheet S curved approximately in the upward direction. As the sheet S is further conveyed, the other surface of the sheet S, facing the pressure roller 82, faces the guide surface 25A.

The circumferential speed of the discharge rollers 23 is higher than the conveyance speed of the sheet S conveyed by the fixer 8. Therefore, while the sheet S is being conveyed by the fixer 8 and the discharge rollers 23, the sheet S is pulled and conveyed by the discharge rollers 23. This configuration may eliminate or minimize a non-negligible level of looseness of the sheet S in the conveyance passage 91. Even though the sheet S is conveyed with toner image on its surface facing the pressure roller 82, the eliminated or minimal looseness of the sheet S may eliminate or minimize forcible contact of the surface having the toner image with the guide surface 25A and a disfigured image that would otherwise result.

Figure 6A:
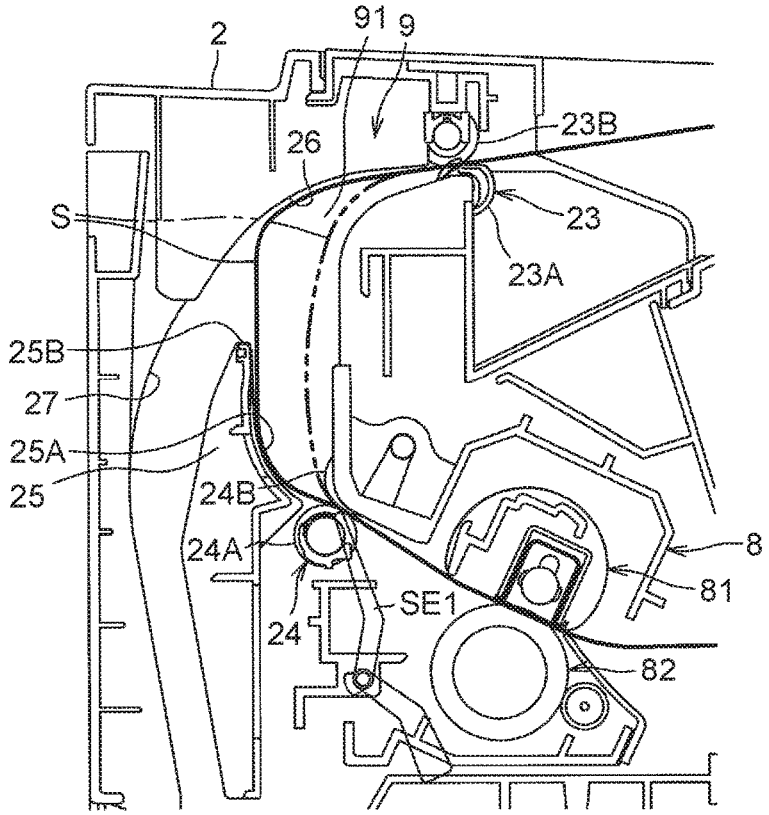
FIG. 6A illustrates how a sheet is conveyed by a fixer and the discharge roller.
Figure 6B:
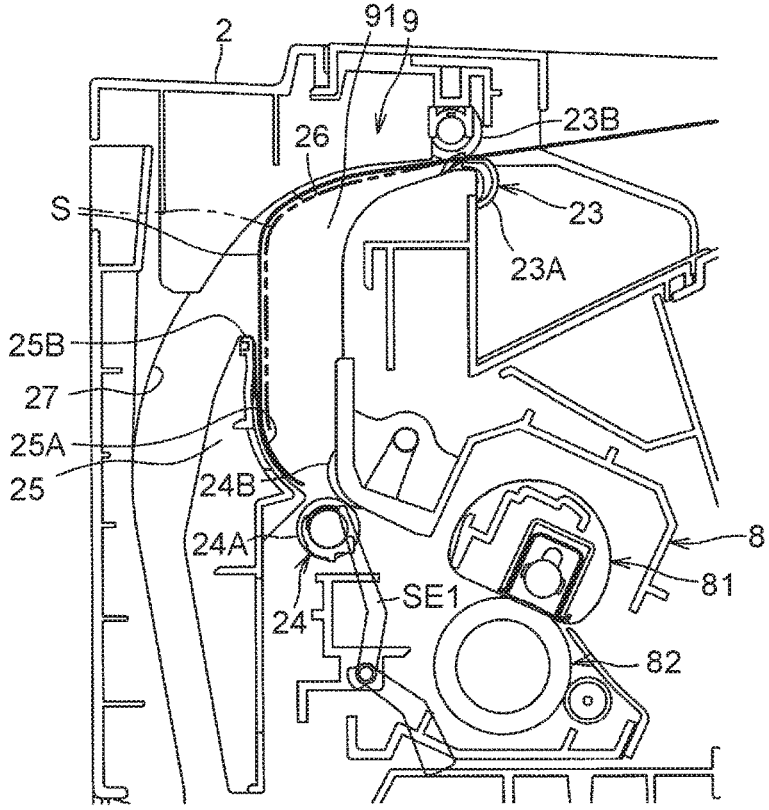
FIG. 6B illustrates the sheet immediately after its trailing end has passed the first sensor.

As illustrated in FIG. 6A, when the length of the sheet S is not less than the above-described predetermined length (see the double-dashed line), the period of time for which the sheet S is conveyed by both the fixer 8 and the discharge rollers 23 is longer than when the length of the sheet S is less than the predetermined length (see the solid line). That is, the sheet S is pulled by the discharge rollers 23 for a longer period of time. Therefore, the level of looseness of the sheet S in the conveyance passage 91 is less when the length of the sheet S is not less than the predetermined length than when the length of the sheet S is less than the predetermined length. When there is a difference in the level of looseness of the sheet S, the trailing end of the sheet S immediately after the trailing end has passed the first sensor SE1 is closer to the discharge rollers 23 when the length of the sheet S is not less than the predetermined length than when the length of the sheet S is less than the predetermined length, as illustrated in FIG. 6B.

Assume that the waiting time T were constant regardless of the length of the sheet S. In this case, after the waiting time T has elapsed since the first sensor SE1 detected the trailing end of the sheet S, the distance between the trailing end of the sheet S and the branching point 25B of the guide member 25 varies depending on the length of the sheet S. Thus, if the waiting time T is constant regardless of the length of the sheet S, the sheet S may not be conveyed in the return passage 92 correctly.

Figure 7:
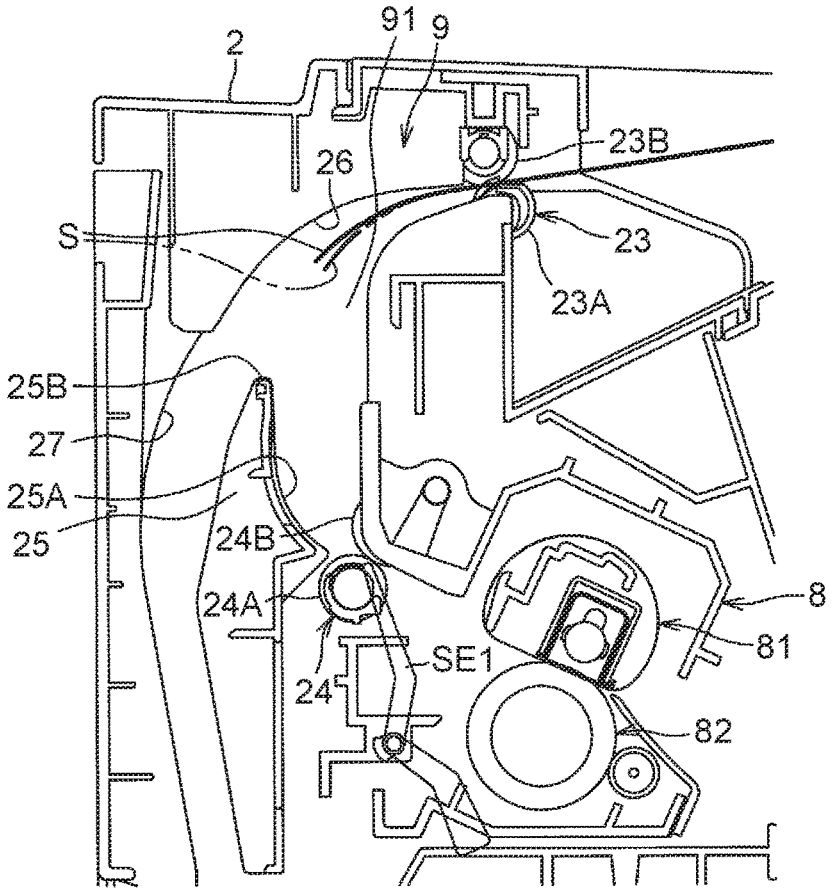
FIG. 7 illustrates the sheet immediately before the discharge roller rotates oppositely.

In this embodiment, the waiting time T is shorter when the length of the sheet S is not less than the predetermined length than when the length of the sheet S is less than the predetermined length. This configuration ensures that as illustrated in FIG. 7, the distance between the trailing end of the sheet S and the branching point 25B at the time when the discharge rollers 23 start rotating oppositely is approximately constant regardless of the length of the sheet S.

As described above, the conveyance speed of the sheet S conveyed by the fixer 8 increases as the number N increases. In view of this situation, in this embodiment, when the number Nis less than the predetermined number N1 and when the length of the sheet S is less than the predetermined length, the waiting time T is set to the second time T2. When the number Nis less than the predetermined number N1 and when the length of the sheet S is not less than the predetermined length, the waiting time T is set to the first time T1, which is less than the second time T2. When the number N is not less than the predetermined number N1 and when the length of the sheet S is less than the predetermined length, the waiting time T is set to the fourth time T4. When the number N is not less than the predetermined number N1 and when the length of the sheet S is not less than the predetermined length, the waiting time T is set to the third time T3, which is shorter than the fourth time T4. This configuration ensures that as illustrated in FIG. 7, the distance between the trailing end of the sheet S and the branching point 25B at the time when the discharge rollers 23 start rotating oppositely is approximately constant regardless of the length of the sheet S.

While the sheet S is being conveyed by both the fixer 8 and the discharge rollers 23, the level of looseness of the sheet S in the conveyance passage 91 improves as the conveyance speed of the sheet S conveyed by the fixer 8 is higher. In view of this situation, in this embodiment, when the number N is not less than the predetermined number N1, that is, when the assumption is made that the conveyance speed of the sheet S conveyed by the fixer 8 is not less than a predetermined speed, the waiting time T is set longer than when the number Nis less than the predetermined number N1, that is, when the assumption is made that the conveyance speed of the sheet S conveyed by the fixer 8 is less than the predetermined speed. This configuration ensures that even though the conveyance speed of the sheet S conveyed by the fixer 8 varies, the distance between the rear end of the sheet S and the branching point 25B at the time when the discharge rollers 23 start rotating oppositely is approximately constant.

The length of the sheet S may be determined based on the ON signal from the second sensor SE2. Since the second sensor SE2 is disposed at a position upstream of the fixer 8 in the forward direction, the length of the sheet S is determined before the trailing end of the sheet S passes the fixer 8. This configuration ensures an appropriate control operation.

Additionally, the second sensor SE2 is disposed between the registration roller 34 and the photosensitive drum 61, which convey the sheet S at approximately identical conveyance speeds. This configuration ensures accurate determination of the length of the sheet S.

The first sensor SE1 is disposed at a position between the conveyance rollers 24 and the heater 81 and the pressure roller 82, where the sheet S is conveyed stably. Since the first sensor SE1 detects the sheet S conveyed stably, the trailing end of the sheet S is detected correctly.

Modifications or variations of the above-described embodiment will be described. Identical or similar elements in the above and following descriptions will be denoted with the same reference numerals and will not be elaborated here.

Figure 8:
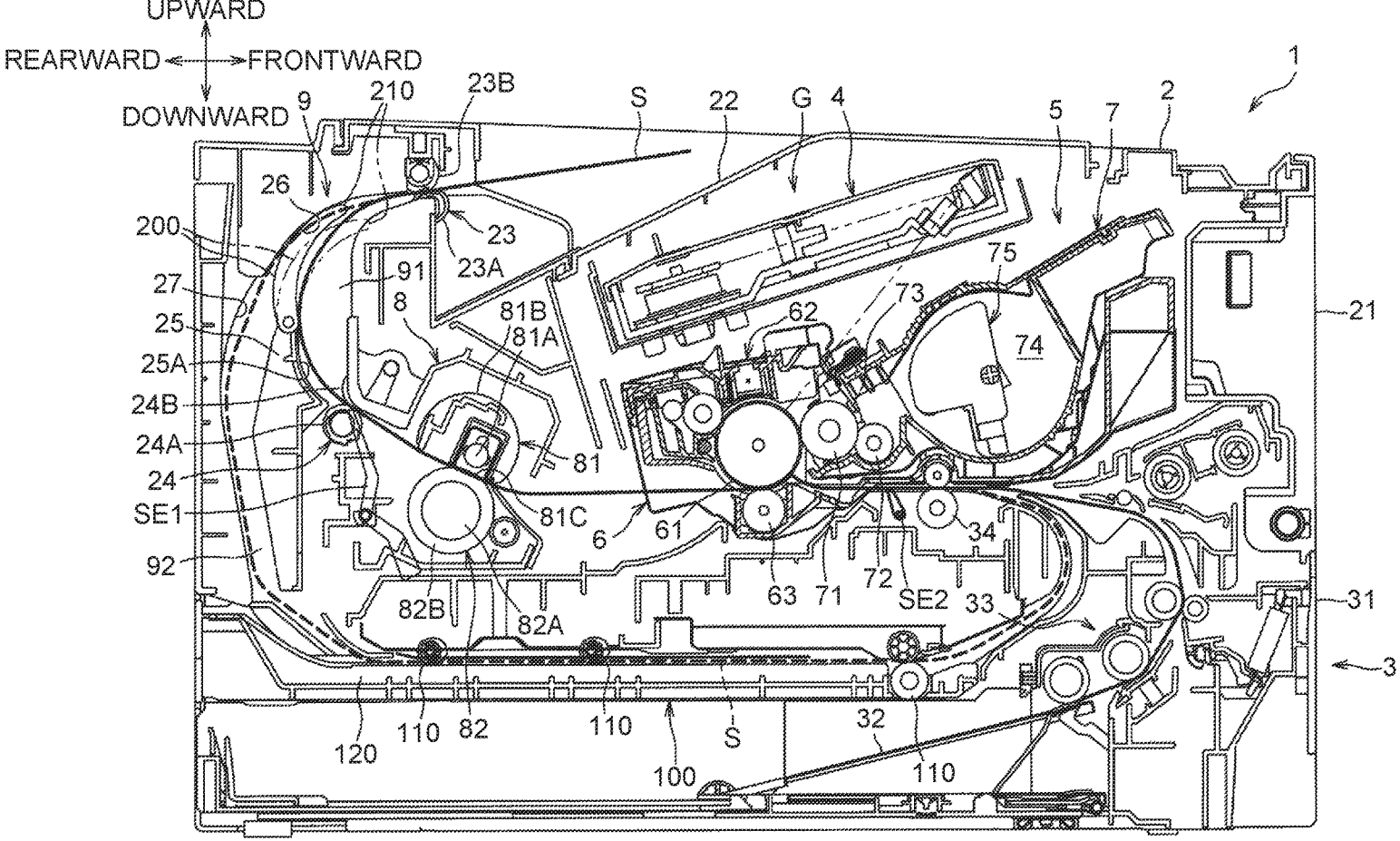
FIG. 8 illustrates another laser printer provided with a flapper at a branching portion.

While in the above-described embodiment a branching member is exemplified as the guide member 25, this configuration is not intended in a limiting sense. In another embodiment illustrated in FIG. 8, the branching member may be a flapper 200. The flapper 200 is disposed at branching portion between the conveyance passage 91 and the return passage 92.

Specifically, the flapper 200 is supported at the upper end of the guide member 25, and extends diagonally upward and toward the front from a swing axis about which the flapper 200 is swingable. The flapper 200 is movable to take a first posture and a second posture. In the first posture, the flapper 200 leaves the conveyance passage 91 open (see the solid line). In order to take the second posture, the flapper 200 swings frontward from the first posture. In the second posture, the flapper 200 blocks the conveyance passage 91 and leaves the return passage 92 open (see the double-dashed line). A distal end of the flapper 200 is closer to the discharge rollers 23 than any other portions of the flapper 200 and serves as the branching point, 210, between the conveyance passage 91 and the return passage 92.

Figure 9:
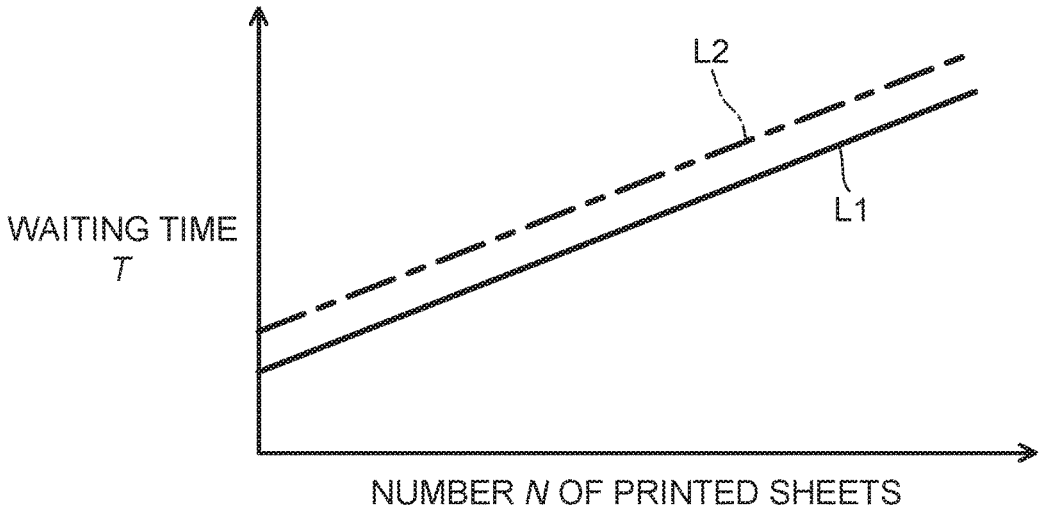
FIG. 9 illustrates the number of sheets printed from a cold start relative to waiting time.

In the above-described embodiment, the waiting time T varies depending on whether the number N is less than the predetermined number N1 or not. This configuration, however, is not intended in a limiting sense. In another embodiment, a plurality of predetermined numbers of sheets S may be set, and each predetermined number may be assigned a different period of waiting time T. In still another embodiment illustrated in FIG. 9, each number N may be paired with a different period of waiting time T, and the waiting time T may become longer as the number N increases.

While in the above-described embodiment the conveyance speed of the sheet S conveyed by the fixer 8 is assumed based on the number N, this configuration is not intended in a limiting sense. In another embodiment, the sheet conveyance speed may be assumed based on the difference between the length of the sheet S detected by the second sensor SE2 and the length of the sheet S detected by the first sensor SE1. Specifically, the controller 10 may set the waiting time T longer as the difference becomes greater between the period of time for which the second sensor SE2 was ON and the period of time for which the first sensor SE1 was ON.

While in the above-described embodiment the second sensor SE2 is disposed between the registration roller 34 and the photosensitive drum 61, this configuration is not intended in a limiting sense. The second sensor SE2 may be disposed at another position as long as another position is upstream of the fixer 8 in the forward direction.

Obviously, numerous modifications and variations of the present disclosure are possible in light of the above teachings. It is therefore to be understood that within the scope of the appended claims, the present disclosure may be practiced otherwise than as specifically described herein.

What is claimed is:

1. An image forming apparatus comprising:
- a process unit configured to form a developing agent image onto a sheet;
- a fixer configured to convey the sheet in a forward direction to fix the developing agent image to the sheet using a heater and a pressurizer of the fixer;
- a reverse roller configured to make a positive rotation to convey the sheet in the forward direction from the fixer, and configured to make an opposite rotation to convey the sheet in an opposite direction opposite to the forward direction;
- a returner configured to return the sheet, conveyed in the opposite direction, to the process unit;
- a branching member configured to guide the sheet from the reverse roller to the returner past a branching point of the branching member, the branching point being located at an end portion of the branching member that is closer to the reverse roller than a remaining portion of the branching member is to the reverse roller;
- a first sensor disposed at a position upstream of the branching point in the forward direction to detect the sheet; and
- a controller configured to:
  - control the reverse roller to make the positive rotation at a circumferential speed higher than a first conveyance speed of the sheet conveyed by the fixer;
  - control the reverse roller to wait for a predetermined period of waiting time after the first sensor has detected a trailing end of the sheet, and
  - reduce the predetermined period of waiting time as a length of the sheet increases.

2. The image forming apparatus according to claim 1, wherein the first sensor is disposed at a position downstream of the fixer in the forward direction.

3. The image forming apparatus according to claim 1, further comprising a second sensor disposed at a position upstream of the fixer in the forward direction to detect the sheet, wherein the controller is configured to determine the length of the sheet based on output of the second sensor.

4. The image forming apparatus according to claim 3, further comprising a first conveyance roller disposed at a position upstream of the process unit in the forward direction, wherein the process unit comprises a photoreceptor that comprises a circumferential speed approximately identical to a circumferential speed of the first conveyance roller, and wherein the second sensor is disposed between the first conveyance roller and the photoreceptor.

5. The image forming apparatus according to claim 1, wherein the branching member comprises a guide surface configured to contact a surface of the sheet facing the pressurizer after the sheet has transferred from the fixer so as to curve the sheet toward the heater.

6. The image forming apparatus according to claim 5, further comprising a guide disposed at a position that is opposed to the fixer across the branching member and that is spaced apart from the branching member and the fixer so as to guide the sheet conveyed in the opposite direction by the reverse roller.

7. The image forming apparatus according to claim 1, further comprising a second conveyance roller disposed between the branching point and the fixer to convey the sheet transferred from the fixer.

8. The image forming apparatus according to claim 7, wherein the first sensor is disposed between the second conveyance roller and the fixer.

9. The image forming apparatus according to claim 7, wherein the second conveyance roller is configured to convey the sheet at a circumferential speed that is higher than a second conveyance speed of the sheet conveyed by the fixer and that is equal to or lower than a circumferential speed of the reverse roller, and wherein a first frictional force generatable between the second conveyance roller and the sheet is smaller than a second frictional force generatable between the sheet and the heater and the pressurizer.

10. The image forming apparatus according to claim 1, wherein the controller is configured to increase the predetermined period of waiting time as the first conveyance speed of the sheet conveyed by the fixer increases.

11. An image forming apparatus comprising:

an electrophotography process cartridge containing developing agent;

a fixer including a heater and a pressurizer for fixing developing agent image to a sheet while conveying the sheet in a forward direction;

a reverse roller disposed downstream of the fixer in the forward direction, the reverse roller being configured to rotate positively for conveying the sheet in the forward direction and to rotate oppositely for conveying the sheet in an opposite direction opposite to the forward direction;

a conveyance passage extending between the fixer and the reverse roller;

a branching member disposed between the fixer and the reverse roller and disposed along the conveyance passage;

a return passage extending between the branching member and the electrophotography process cartridge;

a first sheet-sensor disposed upstream of the branching member along the conveyance passage in the forward direction; and a controller configured to:

control the reverse roller to rotate positively at a circumferential speed greater than a conveyance speed of the sheet conveyed by the fixer;

determine whether a predetermined time elapses since the first sheet-sensor detects a trailing end of the sheet; and control the reverse roller to rotate oppositely when determined that the predetermined time elapses, wherein the predetermined time is a first period when the sheet has a first length, and the predetermined time is a second period when the sheet has a second length less than the first length, and the first period is less than the second period.

12. The image forming apparatus according to claim 11, further comprising a second sheet-sensor disposed upstream of the fixer in the forward direction, wherein the controller is further configured to determine the length of the sheet based on output of the second sheet-sensor.

13. The image forming apparatus according to claim 11, wherein the controller is further configured to:

determine whether a number of printed sheet since a cold start of the image forming apparatus:

wherein the predetermined time is the first period when the sheet has the first length and the number of printed sheet is less than a predetermined number, the predetermined time is the second period when the sheet has the second length and the number of printed sheet is less than the predetermined number, the predetermined time is a third period when the sheet has the first length and the number of printed sheet is not less than the predetermined number, the third period being greater than the first period, and the predetermined time is a fourth period when the sheet has the second length and the number of printed sheet is not less than the predetermined number, the fourth period being greater than the second period.

14. The image forming apparatus according to claim 13, wherein the third period is identical to the second period.

* * * * *